US008213669B2

(12) United States Patent
Lin

(10) Patent No.: US 8,213,669 B2
(45) Date of Patent: Jul. 3, 2012

(54) ROTARY TWEETER MOUNTING ARRANGEMENT FOR A SPEAKER ASSEMBLY

(75) Inventor: Steff Lin, Taipei Hsien (TW)

(73) Assignee: Hi-Tech Sound System Co., Ltd., Taipei (TW)

( * ) Notice: Subject to any disclaimer, the term of this patent is extended or adjusted under 35 U.S.C. 154(b) by 1356 days.

(21) Appl. No.: 11/889,795

(22) Filed: Aug. 16, 2007

(65) Prior Publication Data

US 2009/0046886 A1 Feb. 19, 2009

(51) Int. Cl.
*H04R 1/02* (2006.01)

(52) U.S. Cl. ..... 381/387; 381/395; 181/186

(58) Field of Classification Search ..... 381/182, 381/186, 386, 387, 395; 181/144, 145, 147, 181/199

See application file for complete search history.

(56) References Cited

U.S. PATENT DOCUMENTS 5,859,917 A * 1/1999 Silber et al. ..... 381/389
6,356,640 B1 * 3/2002 Lin ..... 381/182

* cited by examiner

*Primary Examiner* — Tom Thomas
*Assistant Examiner* — Benjamin Tzu-Hung Liu
(74) *Attorney, Agent, or Firm* — Bacon & Thomas, PLLC

(57) ABSTRACT

A rotary tweeter mounting arrangement used in a speaker assembly is disclosed to include a hollow holder member affixed to a T-iron of the speaker assembly and having a cup portion at the top, a semispherical carrier member rotatably supported on the cup portion of the hollow holder member, a circular spring plate mounted in a lower part inside the carrier member, a screw inserted through a center mounting hole of the circular spring plate and a center through hole of the semispherical carrier member to pivotally secure the semispherical carrier member to the hollow holder member, and a face panel fastened to the semispherical carrier member to hold a tweeter for allowing rotation of the tweeter with the face panel and the semispherical carrier member relative to the hollow base member.

3 Claims, 4 Drawing Sheets

ROTARY TWEETER MOUNTING ARRANGEMENT FOR A SPEAKER ASSEMBLY

BACKGROUND OF THE INVENTION

1. Field of the Invention

The present invention relates to speakers and more particularly, to a rotary tweeter mounting arrangement used in a speaker assembly, which allows adjustment of the angle of the tweeter without affecting the tone quality of the speaker assembly.

2. Description of the Related Art

A speaker assembly may be equipped with a tweeter to produce high frequencies, enhancing the sound quality. A conventional speaker assembly with tweeter is known comprising an adjustment carrier carrying the tweeter. The adjustment carrier can be turned forwards, backwards, leftwards, and rightwards to adjust the angle of the tweeter. When adjusting the adjustment carrier, the tweeter is diviated from the axial alignment, affecting the tone quality.

SUMMARY OF THE INVENTION

The present invention has been accomplished under the circumstances in view. It is therefore the main object of the present invention to provide a rotary tweeter mounting arrangement for speaker assembly, which allows adjustment of the angle of the tweeter and keeps the tweeter in axial alignment during adjustment.

According to one aspect of the present invention, the rotary tweeter mounting arrangement rotary tweeter mounting arrangement is used in a speaker assembly, comprising: a hollow holder member affixed to a T-iron of the speaker assembly, the hollow holder member comprising a cylindrical shank, a cup portion at a top side of the cylindrical shank, and a screw hole extending through the center of the cup portion connection into the cylindrical shank; a semispherical carrier member rotatably supported on the cup portion of the hollow holder member, the semispherical carrier member having a center through hole; a circular spring plate mounted in a lower part inside the carrier member, the circular spring plate having a center mounting hole; a screw inserted through the center mounting hole of the circular spring plate and the center through hole of the semispherical carrier member to pivotally secure the semispherical carrier member to the hollow holder member; a face panel fastened to the semispherical carrier member; and a tweeter fastened to the face panel for rotation with the face panel and the semispherical carrier member relative to the hollow base member.

According to another aspect of the present invention, a mounting structure is provided between the top side of the semispherical carrier member and the periphery of the face panel for securing the face panel to the semispherical carrier member. The mounting structure comprises at least one retaining portion disposed at one of the face panel and the semispherical carrier member and at least one hook disposed at the other of the face panel and the semispherical carrier member for fastening to the at least one retaining portion.

According to still another aspect of the present invention, the circular spring plate has an arched locating strip stopped against a part inside the semispherical carrier member to secure the circular spring plate to the inside of the semispherical carrier member.

DETAILED DESCRIPTION OF THE PREFERRED EMBODIMENT

Figure 1:
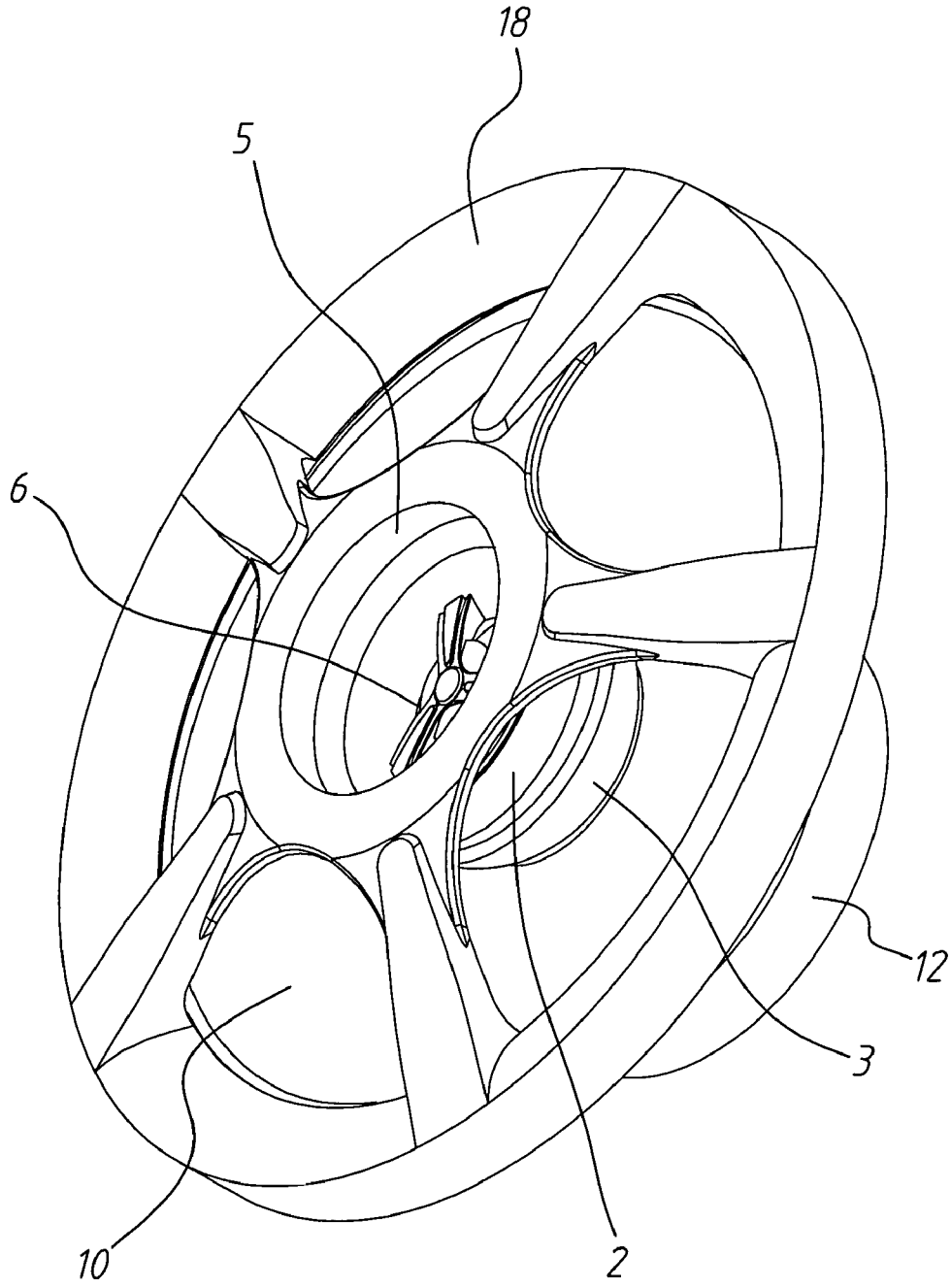
FIG. 1 is a perspective view of the preferred embodiment of the present invention.
Figure 2:
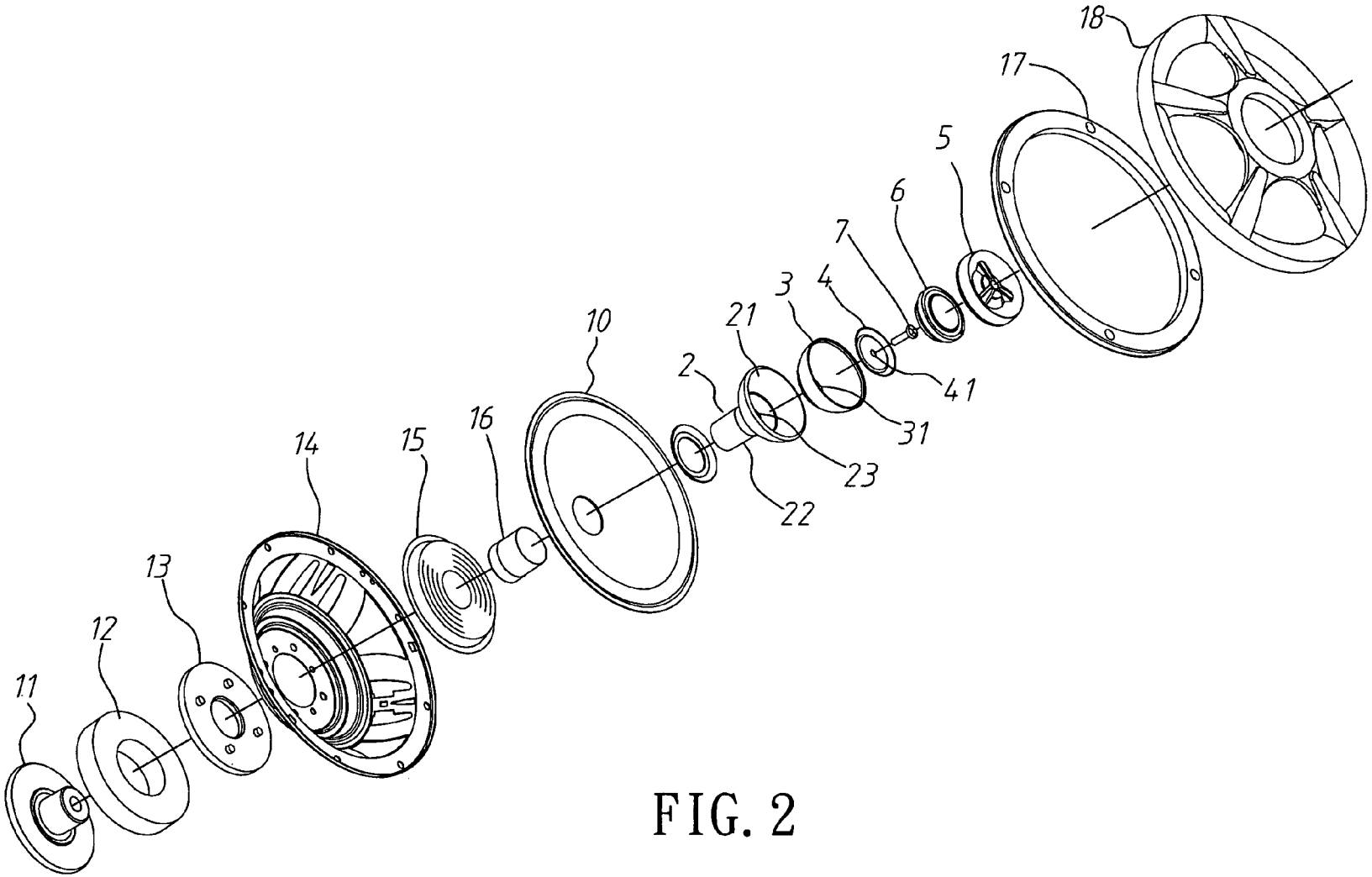
FIG. 2 is an exploded view of the preferred embodiment of the present invention.

Referring to FIGS. 1 and 2, a speaker assembly in accordance with the present invention is shown comprised of a T-iron 11, a magnet 12, a washer 13, a bracket 14, a damper 15 at the bracket 14, a voice coil 16, at the center of the damper 15, a cone paper 10, and a cushion 17 at the top, and an grille 18.

Set between the voice coil 16 and the grille 18, the speaker further comprises:

A hollow holder member 2, which comprises a cylindrical shank 22, a cup portion 21 at the top side of the cylindrical shank 22, and a screw hole 23 extending through the center of the cup portion 21 into the cylindrical shank 22;

a semispherical carrier member 3, which has a diameter approximately equal to the inner diameter of the holder member 2, a circular center through hole 31, and a top retaining portion 32;

a circular spring plate 4, which has a center mounting hole 41, and an arched locating strip 42 protruded from the periphery corresponding to the inner edge of the carrier member 3;

a face panel 5, which has a hook 51 for hooking the top retaining portion 32 of the carrier member 3; and a tweeter 6.

The circular spring plate 4 is in a lower part inside the carrier member 3 and secured thereto by means of stopping the locating strip 42 against the inside wall of the carrier member 3. The carrier member 3 is mounted in the cup portion 21 of the holder member 2. A screw 7 is inserted through the center mounting hole 41 of the circular spring plate 4 and the through hole 31 of the carrier member 3 and threaded into the screw hole 23 of the holder member 2 to secure the circular spring plate 4 and the carrier member 3 to the holder member 2. The face panel 5 is fastened to the tweeter 6 and then the hook 51 of the face panel 5 is fastened to the retaining portion 32 of the carrier member 3 to secure the tweeter 6 to the carrier member 3. The cylindrical shank 22 of the holder member 2 is affixed to the T-iron 11. Thus, the carrier member 3 can be freely rotated on the cup portion 21 of the holder member 2 to adjust the angle of the tweeter 6 while keeping the tweeter 6 in axial alignment without affecting the output tone quality of the speaker assembly.

Figure 3:
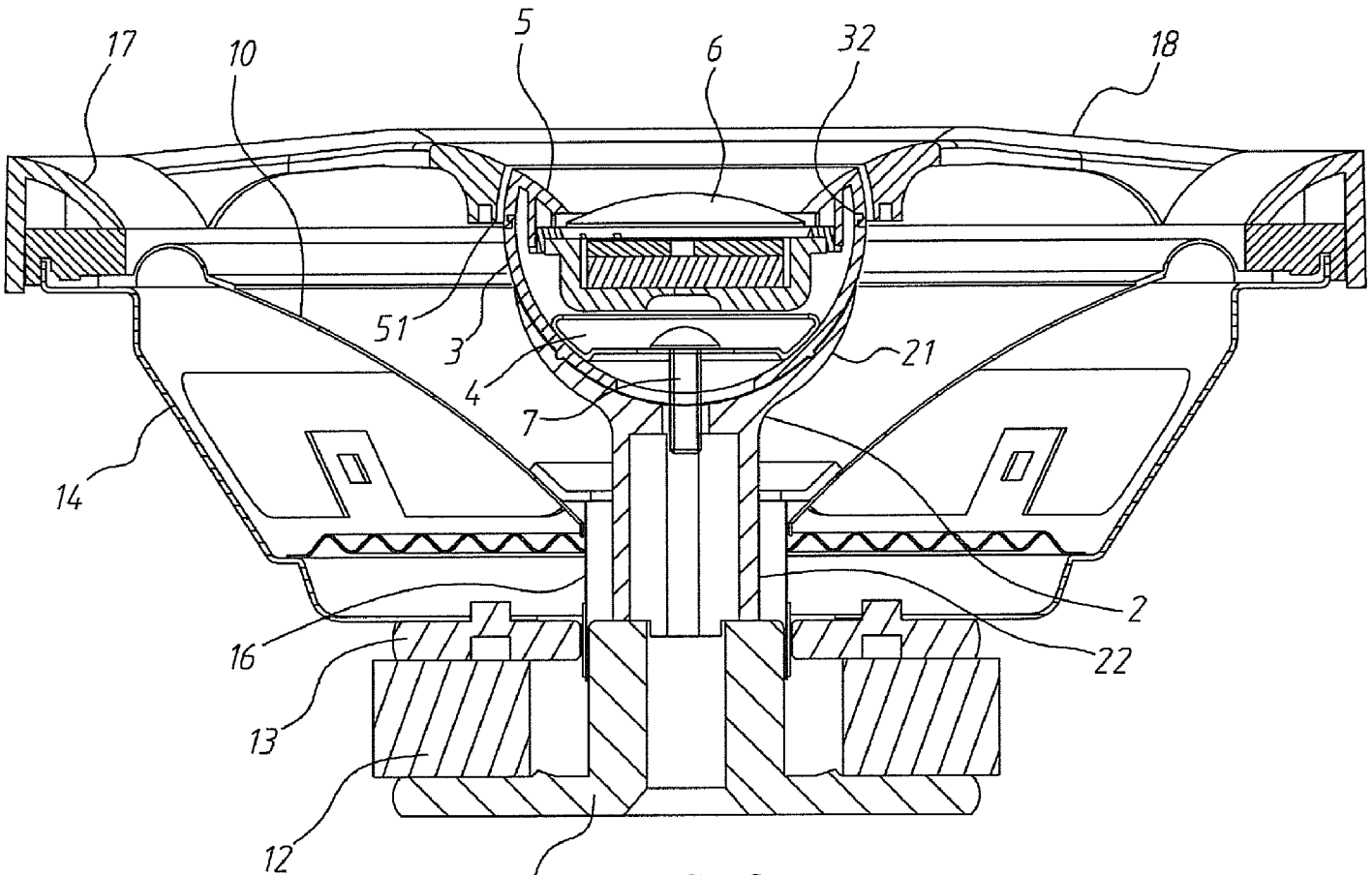
FIG. 3 is a sectional view of the preferred embodiment of the present invention.

Referring to FIG. 3, the circular spring plate 4 is disposed in a lower part inside the carrier member 3 and the carrier member 3 is supported on the cup portion 21 of the holder member 2. The screw 7 is inserted through the center mounting hole 41 of the circular spring plate 4 and the through hole 31 of the carrier member 3 and threaded into the screw hole 23 of the holder member 2 to secure the circular spring plate 4 and the carrier member 3 to the holder member 2, keeping the carrier member 3 is balance and allowing the carrier member 3 to be freely rotated through 360-degrees. The peripheral edge of the through hole 31 prohibits the carrier member 3 from vibration during rotation.

Figure 4:
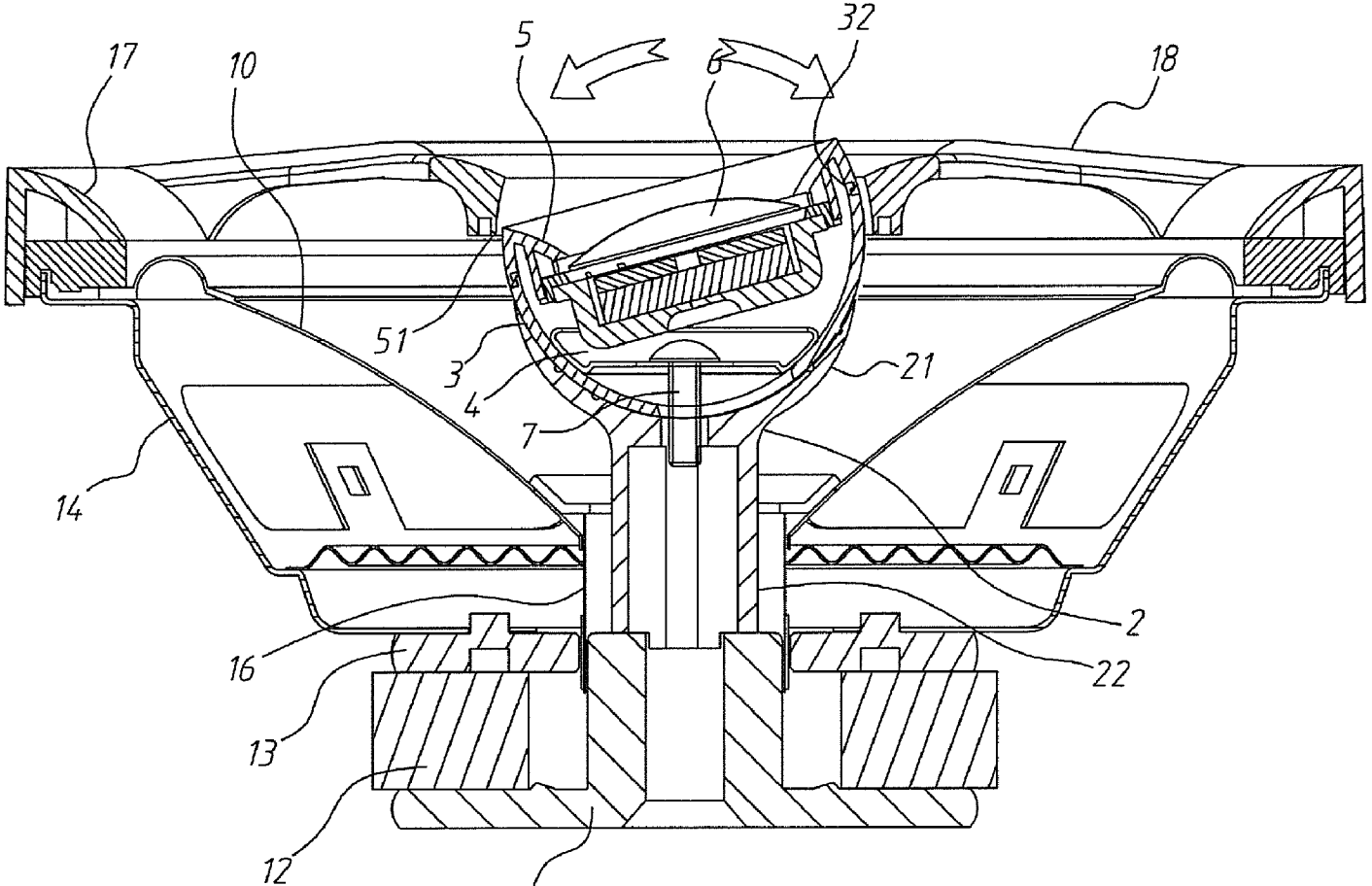
FIG. 4 is a schematic view of the preferred embodiment of the present invention, showing the speaker in operation.

Referring to FIG. 4, when in use, the user can rotate the carrier member 3 to adjust the angle of the tweeter 6. At this time, the peripheral edge of the through hole 31 and the screw 7 prohibit the carrier member 3 from vibration during rotation. Because the angle of the tweeter 6 is changed subject to rotation of the carrier member 3, the tweeter 6 is constantly kept in balance, maintaining optical tone quality.

A prototype of rotary tweeter mounting arrangement for speaker assembly has been constructed with the features of FIGS. 1~4. The rotary tweeter mounting arrangement for speaker assembly functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A rotary tweeter mounting arrangement used in a speaker assembly, comprising:

a hollow holder member affixed to a T-iron of said speaker assembly, said hollow holder member comprising a cylindrical shank, a cup portion at a top side of said cylindrical shank, and a screw hole extending through the center of said cup portion connection into said cylindrical shank;

a semispherical carrier member rotatably supported on the cup portion of said hollow holder member, said semispherical carrier member having a center through hole;

a circular spring plate mounted in a lower part inside said carrier member, said circular spring plate having a center mounting hole;

a screw inserted through the center mounting hole of said circular spring plate and the center through hole of said semispherical carrier member to pivotally secure said semispherical carrier member to said hollow holder member;

a face panel fastened to said semispherical carrier member; and a tweeter fastened to said face panel for rotation with said face panel and said semispherical carrier member relative to said hollow base member.

2. The rotary tweeter mounting arrangement as claimed in claim 1, wherein a mounting structure is provided between a top side of said semispherical carrier member and the periphery of said face panel for securing said face panel to said semispherical carrier member, said mounting structure comprising at least one retaining portion disposed at one of said face panel and said semispherical carrier member and at least one hook disposed at the other of said face panel and said semispherical carrier member for fastening to said at least one retaining portion.

3. The rotary tweeter mounting arrangement as claimed in claim 1, wherein said circular spring plate has an arched locating strip stopped against a part inside said semispherical carrier member to secure said circular spring plate to the inside of said semispherical carrier member.

* * * * *